US010085480B2

(12) United States Patent
Reimann

(10) Patent No.: US 10,085,480 B2
(45) **Date of Patent: *Oct. 2, 2018**

(54) SMOKING PIPE

(71) Applicant: William James Reimann, Boise, ID (US)

(72) Inventor: William James Reimann, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/794,674

(22) Filed: Oct. 26, 2017

(65) Prior Publication Data

US 2018/0042297 A1 Feb. 15, 2018

Related U.S. Application Data

(63) Continuation of application No. 14/877,138, filed on Oct. 7, 2015, now Pat. No. 9,854,834.

(51) Int. Cl.

| | |
|---|---|
| ***A24F 1/32*** | (2006.01) |
| ***A24F 5/10*** | (2006.01) |
| ***A24F 5/04*** | (2006.01) |
| ***A24F 1/08*** | (2006.01) |
| ***A24F 1/30*** | (2006.01) |

(52) U.S. Cl.

CPC ..... *A24F 1/32* (2013.01); *A24F 1/08* (2013.01); *A24F 1/30* (2013.01); *A24F 5/04* (2013.01); *A24F 5/10* (2013.01)

(58) Field of Classification Search

CPC combination set(s) only.
See application file for complete search history.

(56) References Cited

U.S. PATENT DOCUMENTS

| | | | |
|---|---|---|---|
| 373,559 | A | 11/1887 | Kaldenberg |
| 3,872,872 | A | 3/1975 | Kahler |
| 3,881,499 | A | 5/1975 | McFadden et al. |
| 3,882,875 | A | 5/1975 | Frost |
| 4,020,853 | A | 5/1977 | Nuttall |
| 4,241,741 | A | 12/1980 | Cabados et al. |
| 4,253,475 | A | 3/1981 | Schreiber et al. |
| 4,357,948 | A | 11/1982 | Schweitzer et al. |
| 6,935,345 | B2 | 8/2005 | Carstens et al. |

(Continued)

FOREIGN PATENT DOCUMENTS

| | | |
|---|---|---|
| CN | 201640446 | 11/2010 |
| CN | 203087516 | 7/2013 |

(Continued)

OTHER PUBLICATIONS

US Patent and Trademark Office; Office Action for U.S. Appl. No. 14/877,138 dated May 11, 2017.

*Primary Examiner* — Eric Yaary
(74) *Attorney, Agent, or Firm* — Parsons Behle & Latimer

(57) ABSTRACT

The present invention is directed to a smoking pipe having an elastic body that defines an air passage. Preferably the elastic body is formed of a heat resistant silicone. The elastic body included a bowl receiving portion and a stem which define an air passage. The bowl receiving portion also including a groove formed at the proximate to the first end of the air passage and an elastic lip formed adjacent to the groove. The bowl may be removably positioned within the bowl receiving portion with the flange seated in the groove and the elastic lip holding the flange compressively within the groove. The bowl may be formed of stainless steel, brass, titanium, glass or ceramic.

21 Claims, 4 Drawing Sheets

(56) References Cited

U.S. PATENT DOCUMENTS

| | | | |
|---|---|---|---|
| 8,469,225 | B2 | 6/2013 | Fredland |
| 8,534,295 | B2 | 9/2013 | Gonsalves |
| 8,550,091 | B2 | 10/2013 | Yomtov et al. |
| 2003/0178035 | A1 | 9/2003 | Miller |
| 2011/0079231 | A1 | 4/2011 | Borushek et al. |
| 2012/0180803 | A1 | 7/2012 | Beloni |
| 2013/0146070 | A1 | 6/2013 | Ross |
| 2013/0167852 | A1 | 7/2013 | McDonald |
| 2014/0026902 | A1 | 1/2014 | Dabes |
| 2014/0158143 | A1 | 6/2014 | Barrett |
| 2014/0224263 | A1 | 8/2014 | Wilson |
| 2014/0326256 | A1 | 11/2014 | Mckay |
| 2014/0360513 | A1 | 12/2014 | Morgan |
| 2016/0157520 | A1 | 6/2016 | Alfawaz et al. |
| 2017/0000186 | A1 | 1/2017 | Russell |

FOREIGN PATENT DOCUMENTS

| | | | |
|---|---|---|---|
| CN | 203986106 | | 12/2014 |
| EP | 0273770 | A2 | 7/1988 |

SMOKING PIPE

CROSS-REFENENCE TO RELATED APPLICATIONS

This application is a continuation of U.S. patent application Ser. No. 14/877,138, filed on Oct. 7, 2015 and entitled "Smoking Pipe," the contents of which are incorporated herein by reference in its entirety.

BACKGROUND OF THE INVENTION

Technical Field:

The present invention relates generally to smoking pipes and more particularly to a pipe having an elastic body formed of a heat resistant polymer and a removable heat resistant bowl.

Background:

Smoking pipes are well known and have been in use for thousands of years by cultures spanning the globe. According to the prior art, a pipe typically includes a bowl attached to a stem. A bore extends through the stem and connects to the bottom of the bowl. The stem may separate from a shank that extends laterally from the bowl and through which the bore extends. Often times the bowl and shank are formed as a single piece and the stem inserts into the shank and is held in this manner by a mortise and tenon connection. The interior of the bowl forms a combustion chamber into which a dried or substantially dry material, tobacco or the like, is packed and then ignited. Smoke is drawn through the bore by the smoker.

Historically the described structure has been fashioned of materials that are rigid by nature. Briarwood has commonly been used to fashion howls and stems although other woods are popular. Stems have commonly been fashioned of wood or plastic. The prior art also includes pipes made of glass, various metals, ceramic materials and stone. All of these pipes have a single common feature, their rigidity. Pipe stems have been known to break when subjected to forces that exceed their mechanical strength characteristics.

Advantage may be found in providing a smoking pipe that includes a pipe body formed of an elastic material that is readily deformable while having the capability of returning substantially to the pipe's original shape and configuration. Therefore an object of the present invention is to provide a smoking pipe that includes a pipe body formed of an elastic material so that it may be folded, bent, crushed and generally deformed while retaining the capability of returning to its original shape configuration.

Smoking pipes require frequent and thorough cleaning in order to "draw" properly and in order to reduce unwanted tastes that may be experienced when a pipe accumulates residue of previously smoked materials. Cleaning a pipe is a tedious undertaking achieved only partially at best by scraping the bowl with a tool designed for this purpose and by inserting a "pipe cleaner." an implement including a bristle formed on a twisted wire repeatedly through the stem and the draft hole at the bottom of the combustion chamber in an attempt to clean the interior surface of the bore.

Advantage may also then be found in providing a smoking pipe that includes a removable bowl and a pipe body each formed of a material that may be cleaned by immersion in a liquid that acts as a mild solvent or cleaning solution that readily removes built up residue from the pipes surfaces. Therefore another object of the present invention is to provide a smoking pipe that includes a removable bowl and a pipe body each formed of a material that may be cleaned by immersion in a liquid that acts as a mild solvent or cleaning solution that readily removes built up residue from the pipes surfaces.

Pipe smokers often times regulate air flow through the pipe's bore from the combustion chamber to the mouthpiece by placing one or more fingers over the open end of the bowl in a manner that reduces airflow volume while increasing airflow velocity through the combustion chamber. This practice is exercised in the attempt to get the charge in the pipe's combustion chamber to burn hotter or more completely. The risk of burning one's fingers while exercising this practice is obvious.

Advantage may also then be found in providing a smoking pipe that includes a pipe body formed of an elastic material that may be deformed by pinching the stem and holding the stem in a manner that regulates airflow volume while increasing airflow velocity through the combustion chamber in the attempt to get the charge in the pipe's combustion chamber to burn hotter or more completely. Therefore another object of the present invention is to provide a smoking pipe that includes a pipe body formed of an elastic material that may be deformed by pinching the stem and holding the stem in a manner that regulates airflow volume through the pipe stem.

SUMMARY OF THE INVENTION

Accordingly, the present invention is directed to a pipe to be used for smoking that includes a pipe body portion formed of a highly elastic polymer that is heat resistant and which may be subjected to cleaning with boiling water, detergents, isopropyl alcohol and even mild solvents without degradation of the material. Similarly, the present invention is directed to a pipe having a removable bowl that is formed of a material that is heat and flame resistant and which may be subjected to cleaning with boiling water, detergents, isopropyl alcohol and even mild solvents without degradation of the material.

In the preferred embodiment of the invention, silicone is employed to fashion the pipe body, as silicone as a material is characterized by suitable levels of thermal stability, elasticity and chemical resistance. Also in the preferred embodiment of the invention, a food grade stainless steel is used to form the bowl of the pipe, as food grade stainless steel is characterized by suitable levels of flame and heat resistance and chemical stability.

The elasticity and chemical resistance of silicone employed in the manufacture of the pipe body distinguishes the smoking pipe of the present invention over historically used and know smoking pipes. The smoking pipe of the present invention is foldable, bendable and generally deformable, so that it can use safely and packed for travel without fear of breakage or injury. Furthermore, the pipe will easily return to its original shape, absent any appreciable wear or fatigue to the material, thereby enabling the smoking pipe to be stored in a smaller space than required by smoking pipe formed from rigid materials. Additionally, the pipe body, formed of silicone, may be deformed or pinched at a location between the combustion chamber and the mouthpiece in a manner that allows the smoker to regulate air flow through combustion chamber thereby allowing the smoker to stoke the charge.

The bowl may be formed of a food grade stainless steel, cold formed and includes a flange around its uppermost edge. The bowl is formed including one or more draft apertures formed in the lower segment of the bowl. The flange of the bowl is configured to fit snugly within a groove formed near the uppermost edge in the bowl receiving portion of the pipe body. An elastic lip is formed just above the groove near the uppermost edge in the bowl receiving portion of the pipe body. To insert the bowl, the uppermost edge of the bowl receiving portion is stretched about the flange of the bowl. The bowl is inserted into the bowl receiving portion of the pipe body until the flange seats within the groove. The bead closes snugly against the flange of the bowl forming an airtight seal between the pipe body and the bowl.

An alternate embodiment of the smoking pipe is fashioned as a water pipe and the stem is formed to contain water in its lower end.

Inasmuch as the smoking pipe of the present invention includes a removable bowl and a pipe body each formed of a material that is resistant to boiling water, detergents, isopropyl alcohol and even mild solvents without degradation of the material, the smoking pipe may be readily cleaned when required.

DETAILED DESCRIPTION

Figure 1:
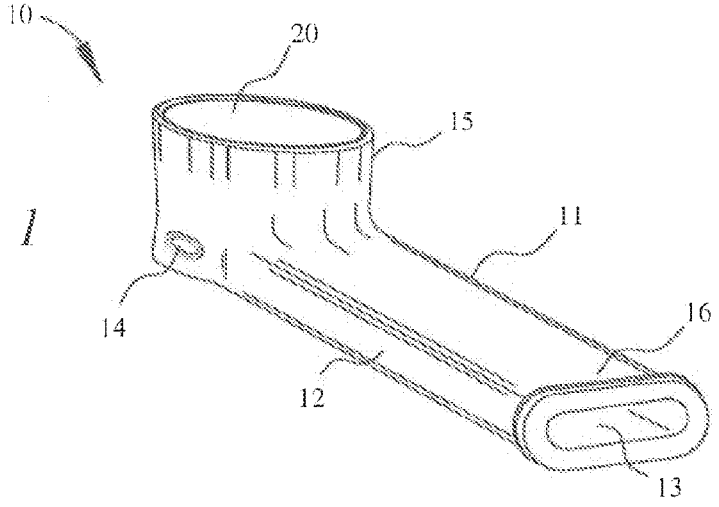
FIG. 1 is a representative isometric view of a smoking pipe according to the present invention.
Figure 2:
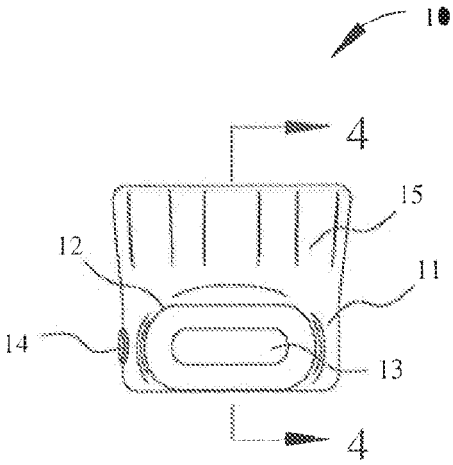
FIG. 2 is a representative front view of a smoking pipe according to the present invention.

FIGS. 1 through 5 show a preferred embodiment of smoking pipe 10 according to the present invention. Figs, 1 through 3 show smoking pipe 10 including pipe body 11 defined generally by stem 12 and bowl receiving portion 15. Stem 12 is shown formed contiguous to bowl receiving portion 15 of pipe body 11 and in the preferred embodiment is molded as a singular piece of silicone. Mouthpiece 16 is located as shown at an end of stem 12. As seen in FIGS. 1 and 2, stem 12 defines in part air passage 13. Airflow regulation aperture 14 is shown in FIGS. 1 and 2 located in the lower segment (plenum portion 22 shown in FIG. 4) of bowl receiving portion 15 and which may be employed as one means to regulate airflow through air passage 13 by selectively covering or uncovering airflow regulation aperture 14. FIG. 1 also shows bowl 20 inserted within the interior of bowl receiving portion 15. Bowl 20 may be formed of any refractory material including for example stainless steel, brass, titanium, glass or ceramic.

Figure 3:
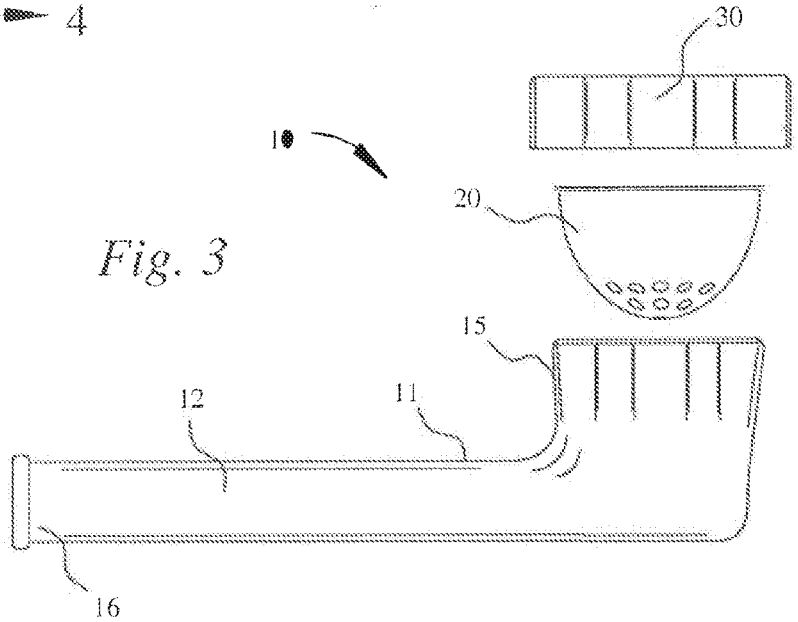
FIG. 3 is a representative exploded side view of a smoking pipe according to the present invention.

FIG. 3 shows bowl 20 removed from bowl receiving portion 15 of elastic body 11. Smoking pipe 10 may include removable cap 30 configured to fit snugly over bowl receiving portion 15 so that a charge may be placed in bowl 20 and covered for later use.

Figure 4:
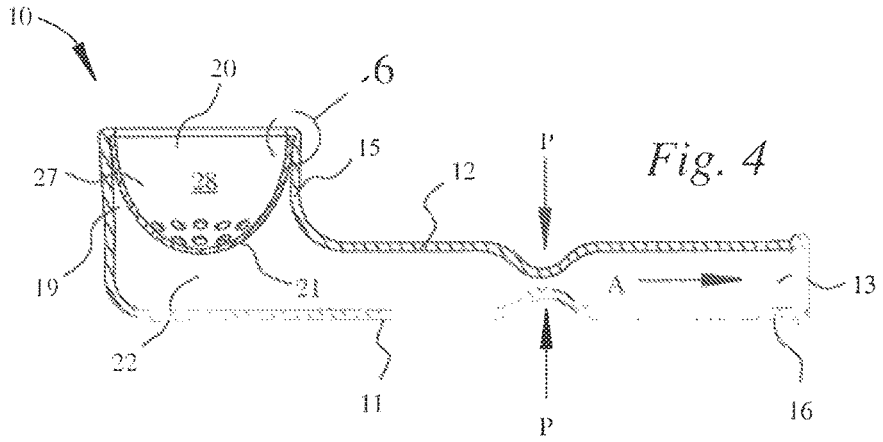
FIG. 4 is a representative cutaway side view of a smoking pipe according to the present invention.

FIG. 4 is a cutaway side view of smoking pipe 10 showing pipe body 11 defined generally by stem 12 and bowl receiving portion 15. Stem 12 defines in part air passage 13. Mouthpiece 16 is located as shown at an end of stem 12. Bowl 20 is shown inserted within interior 19 of bowl receiving portion 15. Bowl 20 is defined in part by sidewall 27. Combustion chamber 28 is defined by the interior of bowl 20. Airflow A is created as air is drawn through stem 12 from mouthpiece 16 pulling air through bowl 20, through the plurality of airflow apertures 21, into plenum 22 located beneath bowl 20 and through air passage 13. Airflow A through pipe stem 12 may be regulated by deforming stem 12 as shown at pinch P produced by applying pressure to opposing surfaces of stem 12. Stem 12, being formed of an elastic material, preferably silicone, returns substantially to its non-deformed configuration when pressure is relaxed at pinch P.

Figure 5:
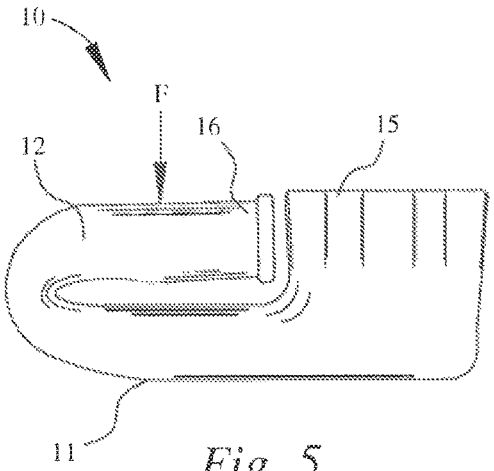
FIG. 5 is a representative side view of a smoking pipe according to the present invention.

FIG. 5 shows smoking pipe 10 including pipe body 11 defined generally by stem 12 and bowl receiving portion 15. Mouthpiece 16 is located as shown proximate to the end of stem 12. Stem 12 is shown bent when folding pressure F is applied in a manner wherein mouthpiece 16 is positioned nearly touching bowl receiving portion 15 allowing for a very compact arrangement. Stem 12, being formed of an elastic material, returns substantially to its unbent configuration when folding pressure F is relaxed.

Figure 6:
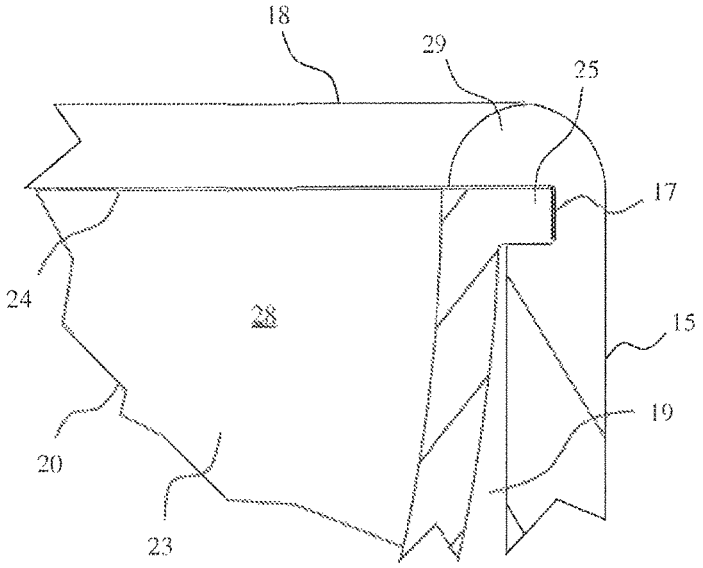
FIG. 6 is a representative cutaway detail side view of a smoking pipe according to the present invention.

FIG. 6 is a cutaway detail side view showing bowl 20 positioned within interior 19 of bowl receiving portion 15. Bowl 20 is shown including sidewall 23 which defines in part combustion chamber 28. Additionally. FIG. 6 shows bowl 20 including flange 25 formed proximate to upper edge 24 of bowl 20. Elastic lip 29 is formed proximate to bowl receiving portion upper edge 18. To insert bowl 20 into bowl receiving portion 15, elastic lip 29 is rolled back slightly allowing flange 25 of bowl 20 to be inserted and seated within groove 17 formed beneath and proximate to elastic lip 29. Once flange 25 is seated within groove 17, elastic lip 29 is released and returns substantially to its non-deformed configuration. Elastic lip 29 seals against flange 25 forming a secure and substantially airtight interface between bowl 20 and bowl receiving portion 15.

Figure 7:
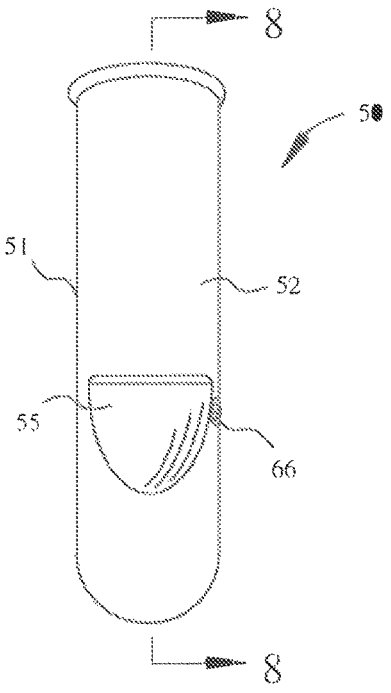
FIG. 7 is a representative isometric view of a smoking pipe according to the present invention.
Figure 9:
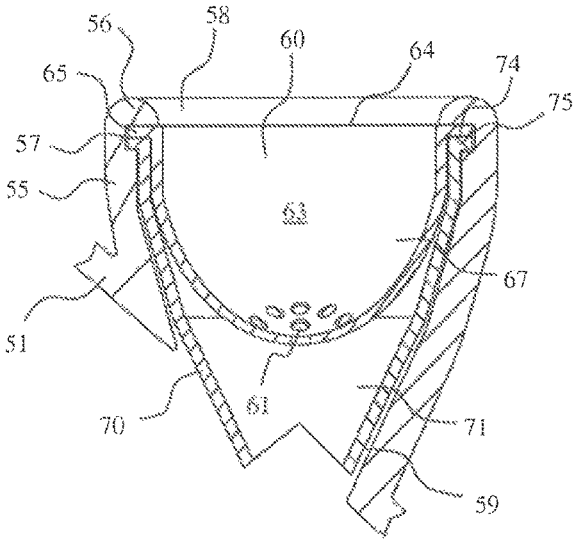
FIG. 9 is a representative cutaway detail side view of a smoking pipe according to the present invention.
Figure 8:
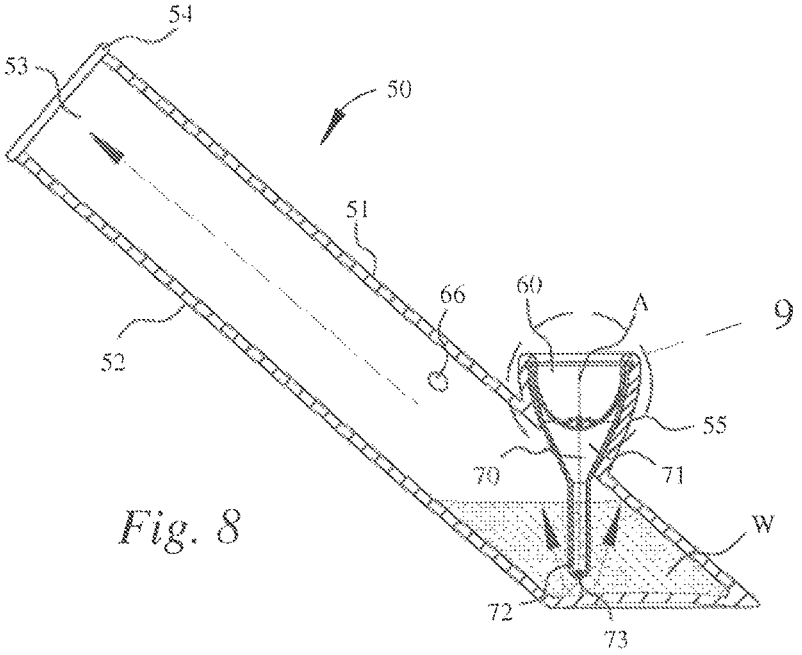
FIG. 8 is a representative cutaway side view of a smoking pipe according to the present invention.
Figure 10:
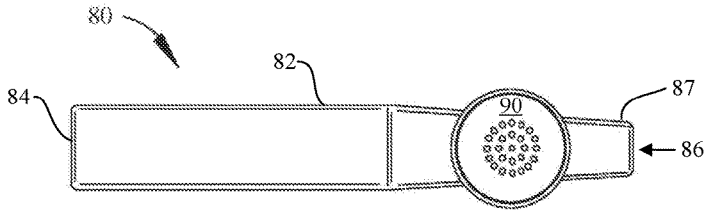
FIG. 10 is a representative top view of a smoking pipe according to the present invention.
Figure 11:
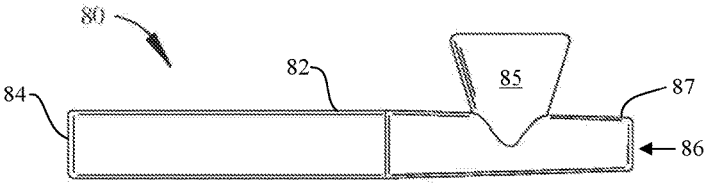
FIG. 11 is a representative side view of a smoking pipe according to the present invention.
Figure 12:
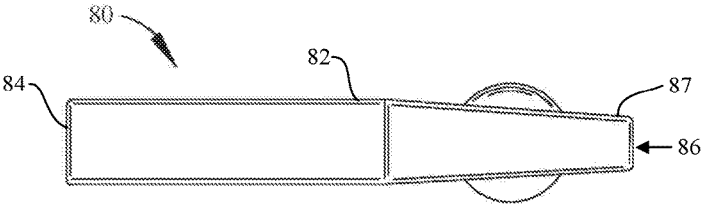
FIG. 12 is a representative bottom view of a smoking pipe according to the present invention.
Figure 13:
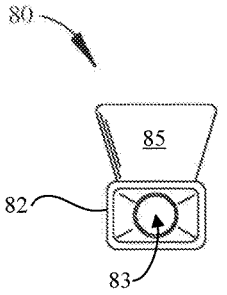
FIG. 13 is a representative front view of a smoking pipe according to the present invention.
Figure 14:
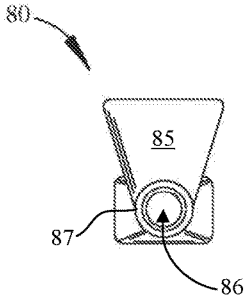
FIG. 14 is a representative rear view of a smoking pipe according to the present invention.

FIGS. 7 through 9 show an alternate embodiment of smoking pipe 50 according to the present invention. As seen in FIGS. 7 and 8, smoking pipe 50 includes pipe body 51 defined generally by stem 52 and bowl receiving portion 55. Stem 52 is shown formed contiguous to bowl receiving portion 55 of pipe body 51 and is molded as a singular piece of silicone. Airflow regulation aperture 66 is shown in 7 and 8 located in stem 52 and which may be employed to regulate airflow through smoking pipe 50 by selectively covering or uncovering airflow regulation aperture 66. Referring to FIG. 8, mouthpiece 54 is located as shown at an end of stem 52. Stem 52 defines in part air passage 53. Bowl 60 is shown inserted within the interior of bowl receiving portion 55.

As shown in FIG. 8, smoking pipe 50 is fashioned as a water pipe, and stem 52 is configured to contain water W in its lower end. Smoking pipe 50 also includes smoke conduit 70. Smoke conduit 70 is formed including a conical segment 71 and is removably positioned within bowl receiving portion 55 positioned below or downstream of bowl 60. Conical segment 71 is configured to permit placement of bowl 60 at least partially within smoke conical segment 71. Smoke conduit 70 also includes bubbler tube 72 which extends from conical segment 71. One or more bubble apertures 73 are formed at a distal end of bubbler tube 72. As airflow A is drawn through bowl 60 it passes through smoke conduit 70 exiting bubbler tube 72 at bubble apertures 73. Air bubbles up through water W and is drawn through air passage 53 to mouthpiece 54.

FIG. 9 is a cutaway detail side view showing bowl 60 and smoke conduit 70 positioned within interior 59 of bowl receiving portion 55. Bowl 60 is shown including sidewall 67 which defines in part combustion chamber 68. One or more draught apertures 61 are formed near the bottom of bowl 60. Bowl 60 is shown including bowl flange 65 formed proximate to upper edge 64 of bowl 60. Similarly, smoke conduit 70 is configured having smoke channel flange 75 formed proximate to upper edge 74 of conical segment 71. Conical segment 71 is sized and configured so as to permit placement of bowl 60 within an interior portion of conical segment 71 such that bowl 60 fits snugly within conical segment 71 and a lower face of bowl flange 65 is supported against an upper surface of smoke channel flange 75.

Elastic lip 56 is formed proximate to upper edge 58 of bowl receiving portion 55. To insert smoke conduit 70 and bowl 60 into bowl receiving portion 55, elastic lip 56 is rolled back slightly allowing smoke channel flange 75 and bowl flange 65 to be inserted and seated within groove 57 formed beneath and proximate to elastic lip 56. Once smoke channel flange 75 and bowl flange 65 are seated within groove 57, elastic lip 56 is released and returns substantially to its non-deformed configuration. Elastic lip 56 seals against bowl flange 65 forming a secure and substantially airtight interface between bowl 60 and bowl receiving portion 55.

Figure 15:
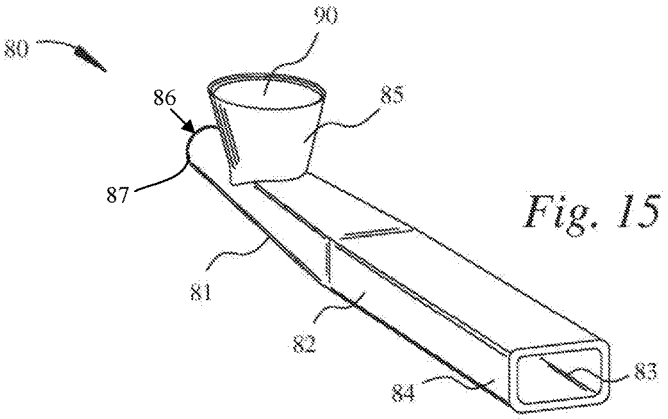
FIG. 15 is a representative isometric view of a smoking pipe according to the present invention.

FIGS. 10 through 15 show an alternate embodiment of smoking pipe 80 according to the present invention. As seen in FIG. 15, smoking pipe 80 including pipe body 81 defined generally by stem 82 and bowl receiving portion 85. Stem 82 is shown formed contiguous to bowl receiving portion 85 of pipe body 81 and is molded as a singular piece of silicone. Mouthpiece 84 is located as shown at an end of stem 82. Stem 82 defines in part air passage 83. Bowl 90 is shown inserted within the interior of bowl receiving portion 85. At the terminus of the other end of the stem 82 is a tip 87 that includes an airflow regulation aperture 86.

The foregoing description of the illustrated embodiments has been presented for purposes of illustration and description and is not intended to be exhaustive or to limit the invention to the precise form or to exemplary embodiment (s) and implementation(s) disclosed. Modifications and variations will be apparent to practitioners skilled in this art. Process steps described might be interchangeable with other steps in order to achieve the same result. At least one preferred embodiment was chosen and described in order to best explain the principles of the invention and a best mode of practical application, thereby to enable others skilled in the art to understand the invention and the various modifications that are suited to the particular use or implementation contemplated. The scope of the invention is defined by the claims appended hereto and their equivalents. Reference to an element in the singular is not intended to mean "one and only one" unless explicitly so stated, but rather means "one or more." No claim element herein is to be construed under the provisions of 35 U.S.C. Sec. 112, sixth paragraph unless the element is expressly recited using the phrase "means for . . . "

What is claimed is:

1. A smoking pipe comprising an elastic pipe body comprising:

an elastic bowl receiving portion integrally formed in a first end of the elastic pipe body, the bowl receiving portion comprising an elastic lip at a bowl receiving portion upper edge, the elastic lip extending over a circumferential groove in a sidewall of the bowl receiving portion, the circumferential groove located proximate to the bowl receiving portion upper edge;

a mouthpiece integrally formed in a second end of the elastic pipe body; and a deformable stem extending from the first end of the elastic pipe body to the second end of the elastic pipe body and defining an air passage there between;

a bowl removably positioned within the bowl receiving portion, the bowl comprising one or more bowl airflow apertures proximate a bottom side of the bowl, and a flange at a bowl upper edge, the flange extending radially outward from the bowl upper edge and shaped to mate with the groove in the sidewall of the bowl receiving portion and be covered by the elastic lip when mated with the groove; and a pipe body airflow regulation aperture located proximate a plenum portion and in a sidewall of the bowl receiving portion located at the first end of the pipe body.

2. The smoking pipe of claim 1 wherein the elastic pipe body further comprises heat resistant silicone.

3. The smoking pipe of claim 1 wherein the bowl further comprises a bowl formed of a material selected from the group of materials including stainless steel, brass, titanium, glass and ceramic.

4. The smoking pipe of claim 1 wherein the deformable stem is configured so that air flow through the air passage may be restricted by applying a pinching force against opposing sides of the stem thereby forming a restricted air passage.

5. The smoking pipe of claim 1 further comprising a removable cap configured to fit over the bowl receiving portion upper edge.

6. The smoking pipe of claim 1 wherein the deformable stem is substantially oval in cross-section.

7. The smoking pipe of claim 1 wherein the deformable stem is substantially rectangular in cross-section.

8. The smoking pipe of claim 1 wherein the deformable stem is oriented substantially perpendicular to the bowl receiving portion.

9. A smoking pipe comprising:

an elastic body formed of a heat resistant silicone;

the elastic body comprising a bowl receiving portion located along a deformable stem, spaced apart from a terminus of a first end of the deformable stem;

the deformable stem having a substantially rectangular cross-section, and in fluid communication with the bowl receiving portion and defining an air passage extending from the top of the bowl receiving portion to a mouthpiece located in a second end of the elastic body;

the bowl receiving portion comprising an elastic lip at a bowl receiving portion upper edge, the elastic lip extending over a circumferential groove in a sidewall of the bowl receiving portion, the circumferential groove located proximate to the bowl receiving portion upper edge and encircling the air passage at the top of the bowl receiving portion; and a bowl removably positioned within the bowl receiving portion, the bowl comprising one or more airflow apertures proximate a bottom side of the bowl, and a flange at a bowl upper edge, the flange extending radially outward from the bowl upper edge and shaped to mate with the groove in the sidewall of the bowl receiving portion and be covered by the elastic lip when mated with the groove.

10. The smoking pipe of claim 9 wherein the bowl further comprises a bowl formed of a material selected from the group of materials including stainless steel, brass, titanium, glass and ceramic.

11. The smoking pipe of claim 9 further comprising an airflow regulation aperture formed in the terminus of the first end of the deformable stem.

12. The smoking pipe of claim 9 wherein the deformable stem is configured so that air flow through the air passage may be restricted by applying a pinching force against opposing sides of the stem thereby forming a restricted air passage.

13. The smoking pipe of claim 9 further comprising a removable cap configured to fit over the bowl receiving portion upper edge.

14. The smoking pipe of claim 9 wherein the deformable stem is oriented substantially perpendicular to the bowl receiving portion.

15. A smoking pipe comprising:

an elastic body formed of a heat resistant silicone, the elastic body including a bowl receiving portion located proximate to a first end of the elastic body and defining a first end of an air passage and a stem fluidly communicating along the air passage with the bowl receiving portion, the bowl receiving portion also comprising a bowl receiving portion upper edge and a groove formed in a sidewall of the bowl receiving portion proximate to the bowl receiving portion upper edge and encircling the first end of the air passage, the bowl receiving portion also including an elastic lip formed at the bowl receiving portion upper edge and shaped to extend over the groove; and a bowl removably positioned within the bowl receiving portion, the bowl formed of a material selected from the group of materials including stainless steel, brass, titanium, glass and ceramic, the bowl comprising one or more airflow apertures proximate a bottom side of the bowl, the bowl including a flange formed at an upper edge of the bowl and extending radially outward about a circumference of the upper edge of the bowl, the flange configured to seat within the groove, and the elastic lip adapted to cover and hold the flange compressively within the groove.

16. The smoking pipe of claim 15 wherein the stem configured so that air flow through the air passage may be restricted by applying a pinching force against substantially opposing sides of the stem creating a restricted air passage, the flange configured to seat within the groove formed at the proximate to the first end of the air passage, and the elastic lip adapted to hold the flange compressively within the groove.

17. The smoking pipe of claim 15 further comprising a removable cap configured to fit over the bowl receiving portion upper edge.

18. The smoking pipe of claim 15 wherein the deformable stem is either substantially oval in cross-section or substantially rectangular in cross-section.

19. The smoking pipe of claim 15 wherein the deformable stem is oriented substantially perpendicular to the bowl receiving portion.

20. The smoking pipe of claim 15 wherein the first end further comprises a tip located at the terminus of the first end and wherein the bowl receiving portion is located along the stem and spaced apart from the tip.

21. The smoking pipe of claim 20 wherein a pipe body airflow regulation aperture is located in the tip of the first end.

* * * * *